US008546675B1

(12) United States Patent
Hirshberg

(10) Patent No.: US 8,546,675 B1
(45) Date of Patent: Oct. 1, 2013

(54) SYNTHESIZED STRING TUNER

(76) Inventor: David Hirshberg, Haifa (IL)

( * ) Notice: Subject to any disclaimer, the term of this patent is extended or adjusted under 35 U.S.C. 154(b) by 0 days.

(21) Appl. No.: 13/591,250

(22) Filed: Aug. 22, 2012

(51) Int. Cl.
*G10H 5/00* (2006.01)
*G10G 7/02* (2006.01)

(52) U.S. Cl.
USPC ..... 84/654; 84/454; 84/455

(58) Field of Classification Search
USPC ..... 84/616, 654, 312 R, 454, 455
See application file for complete search history.

(56) References Cited

U.S. PATENT DOCUMENTS 5,206,446 A 4/1993 Matsumoto et al.
5,343,793 A * 9/1994 Pattie ..... 84/454
5,767,429 A 6/1998 Milano et al.
5,977,467 A * 11/1999 Freeland et al. ..... 84/454
6,995,311 B2 * 2/2006 Stevenson ..... 84/737
7,786,373 B2 8/2010 Adams
8,003,877 B2 8/2011 Elion
2005/0204897 A1 9/2005 Adams et al.
2008/0105107 A1 5/2008 Adams
2008/0271594 A1 11/2008 Starr

* cited by examiner

*Primary Examiner* — Jeffrey Donels

(57) ABSTRACT

A method for tuning a musical instrument comprising: (a) digitizing the vibration of at least one vibrating element of the instrument; (b) estimating the fundamental frequency of the vibration; and (c) conditioned upon at least the estimated frequency, generate an audio signal that comprises the characteristics of the original vibration signal with a different fundamental frequency.

20 Claims, 8 Drawing Sheets

SYNTHESIZED STRING TUNER

FIELD AND BACKGROUND OF THE INVENTION

The present invention, in some embodiments thereof, relates to musical instruments and, more particularly, but not exclusively, to a string based musical instruments.

String musical instruments are very popular. Guitar, Piano, Harp, Sitar and Violin are all string instruments. The basic physical formulation of the vibration frequency is a function of the length of the string the materials of the string and the tension of the string. Those parameters impose a major constrain in the design of a string based musical instrument. Furthermore, the fact that the vibration frequency is in opposite linear relation with length dictates the length of the device and the fret board spacing in devices where the string tune is adjusted by changing the length of the vibrating portion of the strings, for example, in guitars and violin.

One known problem of string musical instrument is the need for constant tuning to mach the instrument to musical note standard and to match the frequency relationship between different strings. This is usually done manually by the musician by rotating a screw that changes the tension of the strings.

In the middle of the $20^{th}$ century with the emerging of electronics many new musical instrument where made by the advantage of electronic circuits. Electronic based musical instruments used a signal synthesizer that is based on accurate time base, usually a quartz crystal, accurate time base eliminates the need for tuning the musical instrument.

Some musical instrument like organ and piano, that where played by keyboards, where replaced quit well by keyboard synthesizers that sufficiently mimic the sound generated by their counterpart analog musical instrument. Other instruments, especially string instrument where the strings are directly activated by the player fingers, like guitar or harp or by a bow and fingers like violin where not been replaced or mimicked adequately by their electronic synthesized instrument counterpart. The main reason for that is the richness of the sound produced by those instrument that where insufficient mimicked by the synthesizers.

The electric guitar which is one of the most popular instrument in modern music is actually did not change since its initial development in the early years of the $20^{th}$ century. The actual guitar structure is similar to a classic guitar while the electronic part is only pickup the vibration signal, amplify it and do some sound effect on it like distortion or modulating the original signal. The tuning problem is addressed today mostly by a stand alone tuner instruments. U.S. Pat. No. 3,881,389 filed on May 21, 1973, teaches an early electronic version of such tuner. Digital versions using digital signal processing and digital display are common and well known in the art.

Guitars that are integrating the tuner with motor drivers and adjust the string tension automatically are known as "Robot guitars" and are also start to be offered in recent years. U.S. Pat. No. 5,767,429 filed on Nov. 9, 1995, U.S. Pat. No. 6,184,452 filed on Dec. 19, 1997, and U.S. Pat. No. 7,786,373 filed on Jan. 19, 2005 are example for patents that teach such solutions.

From a different direction there is on going effort to deliver a new guitars-like musical instrument that are based on pure synthesized audio signal. Those devices known as guitar synthesizers are actually similar to keyboard synthesizer that held like a guitar and enable playing the notes similar, more or less, to playing a guitar.

Many guitar synthesizers were suggested and developed. In early days finger location on the fret board was captured by press buttons. In more modern design the fret board is a touch sensitive surface. The strings in those guitar synthesizers are used only to pick the time and the strength of the pluck and the string vibrations generally are not used to synthesize the sound signal. Harmonics, palm mutes, hammer-ons (in which the fretting hand strikes the string onto the fret board), pull-offs, and pick slides are known guitar playing techniques that are not easily produced by guitar synthesizers. Usually, the strings lay only on the guitar body and not on the fret board. In some cases the string are replaced with "virtual strings"—an alternative way to pick the string pluck time. Those virtual strings can be mechanical buttons, laser light beams, touch surface, etc. An example of guitar synthesizer related patents are U.S. Pat. No. 8,003,877 filed on Sep. 26, 2008, U.S. patent application Ser. No. 12/115,519 filed on May 5, 2008, and U.S. patent application Ser. No. 11/731,449 filed on Mar. 30, 2007.

SUMMARY OF THE INVENTION

The present invention is an electronic tuner to musical instruments with vibration elements such as string. The invention change the fundamental frequency of the vibration elements electronically allowing both fine tuning and major tune change of the instrument, According to an aspect of some embodiments of the present invention there is provided a musical instrument comprising: (a) one or more strings; (b) a string vibration digitizer for at least one string; (c) an estimator that measures the fundamental vibration frequency of the string; and (d) a synthesized tuner, that conditioned upon at least the estimated frequency, generate an audio signal that comprises the characteristics of the original string vibration signal with a different fundamental frequency.

According to some embodiments of the invention, the musical instrument synthesized tuner is used to fine tune the string fundamental frequency to the audio signal with a frequency of a near musical note without changing the tension of the string.

According to some embodiments of the invention, the musical instrument synthesized tuner is used to tune the string fundamental frequency to the audio signal with considerably different frequency.

According to some embodiments of the invention, the musical instrument synthesized tuner is used to tune the strings to the audio signal comprises set of frequencies with exact frequency difference between corresponding the strings sounds.

According to some embodiments of the invention, the musical instrument comprising identical strings and the synthesized tuner is used to tune each the string to different frequency.

According to some embodiments of the invention, the musical instrument synthesized tuner is used to make a significant change in the range of frequencies produced by the instrument.

According to some embodiments of the invention, the musical instrument synthesized tuner is used to alter the fundamental frequencies produces by the string in different fret board positions.

According to some embodiments of the invention, the musical instrument is a guitar or a violin or a harp or a bowed string instrument or a plucked string instrument or a struck string instrument.

According to some embodiments of the invention, the musical instrument synthesized tuner comprises frequency down conversion followed by phase multiplication processing that furthered followed by frequency up conversion.

According to some embodiments of the invention, the musical instrument synthesized tuner comprises harmonics removal before the signal tuning and harmonics insertion after the signal tuning.

According to some embodiments of the invention, the musical instrument synthesized tuner comprises at least one of (a) frequency down conversion; (b) phase signal multiplication; (c) frequency up conversion; (d) frequency demodulation; (e) amplitude demodulation; (f) phase signal multiplication; (g) frequency modulation (h) amplitude modulation; (i) harmonics removal; (j) harmonics insertion; (k) frequency domain stretch, shrink and shift operations; and (l) time domain stretch, shrink and shift operations.

According to some embodiments of the invention, the musical instrument estimator estimate the string open string fundamental frequency or played fundamental frequency or both.

According to an aspect of some embodiments of the present invention there is provided a musical instrument comprising: (a) one or more vibrating elements; (b) a vibration digitizer for at least one the vibrating element; (c) an estimator that measures the fundamental vibration frequency of the vibrating element; and (d) a synthesized tuner, that conditioned upon at least the estimated frequency, generate an audio signal that comprises the characteristics of the original vibration signal with a different fundamental frequency.

According to an aspect of some embodiments of the present invention there is provided a method to tune musical instrument comprising: (a) digitizing the vibration of at least one vibrating element of the instrument; (b) estimating the fundamental frequency of the vibration; and (c) conditioned upon at least the estimated frequency, generate an audio signal that comprises the characteristics of the original vibration signal with a different fundamental frequency.

According to some embodiments of the invention, the method different fundamental frequency is a fine tune of the vibrating element fundamental frequency to the audio signal with a fundamental frequency of a near musical note.

According to some embodiments of the invention, the method different fundamental frequency is a considerably different frequency.

According to some embodiments of the invention, the method different fundamental frequency for each the vibrating element comprises a set of frequencies with exact frequency difference between each other.

According to some embodiments of the invention, the vibrating elements are identical and the different fundamental frequencies are different frequencies.

According to some embodiments of the invention, the method different fundamental frequencies make a significant change in the range of frequencies produced by the instrument. According to some embodiments of the invention, According to some embodiments of the invention, the musical instrument is a guitar or a violin or a harp or a xylophone or a bowed string instrument or a plucked string instrument or a struck string instrument.

According to some embodiments of the invention, the step of generating an audio signal comprises at least one of (a) frequency down conversion; (b) phase signal multiplication; (c) frequency up conversion; (d) frequency demodulation; (e) amplitude demodulation; (f) phase signal multiplication; (g) frequency modulation (h) amplitude modulation; (i) harmonics removal; (j) harmonics insertion; (k) frequency domain stretch, shrink and shift operations; and (l) time domain stretch, shrink and shift operations.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well.

BRIEF DESCRIPTION OF THE DRAWINGS

Some embodiments of the invention are herein described, by way of example only, with reference to the accompanying drawings. [IF IMAGES, REPHRASE] With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
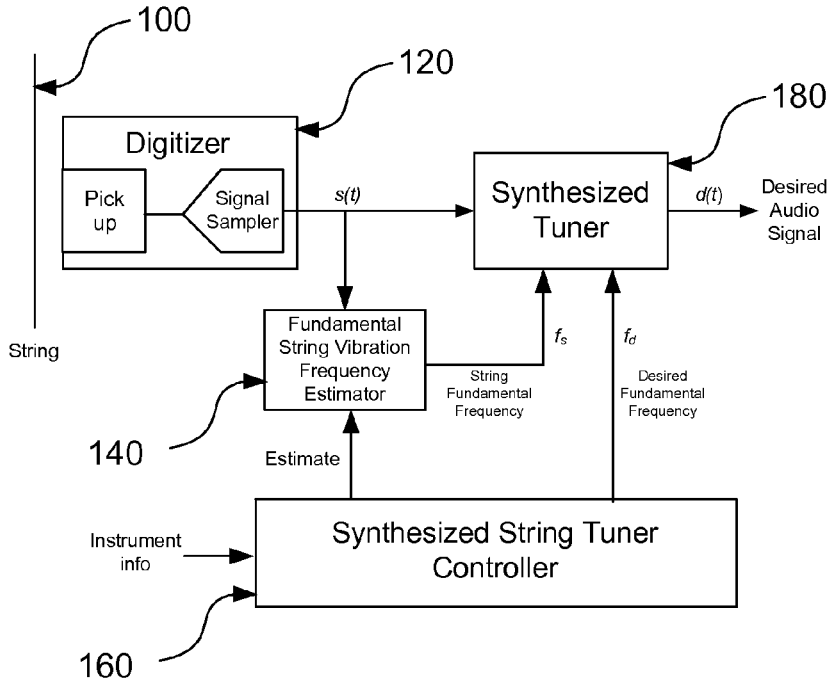
FIG. 1 is a block diagram of a conceptual single string minimal system.

The present invention, in some embodiments thereof, relates to musical instruments and, more particularly, but not exclusively, to a string based musical instruments.

String based musical instrument allow the player to have a rich and delicate control of the sound produced by the instrument. Playing techniques in guitar such as pinch harmonics, tapped harmonics, palm mutes, hammer-ons, pull-offs, pick slides and others are not adequately produce by guitar synthesizers. MIDI type guitar synthesizer and the guitar controllers that controls MIDI type guitar synthesizer pick only the pluck time and pluck strength as well as the fret position or the fundamental tone to be played. On the other hand standard electronic guitar can pick all the richness of the string sound but is subjected to disadvantages of analog musical instrument such as constant need for tuning the strings as well as limitation in the size of the guitar, the location of frets, the type of the strings, the reliability of the strings, etc.

The current invention bridges between those two ends and provide a more flexible string instrument that eliminate the need of tuning (as in digital synthesizers) and provide much more flexible design constrains for the musical instrument designer. Length of the strings, the frets locations and the type of strings are not obey hard limitation and can be chosen by other requirements, such as comfort or reliability, and they are not limited to the tone the instrument should produce.

The principle idea behind the invention is to decompose the string sound to its two components: the fundamental frequency and all other string sound artifacts such as harmonics, amplitude modulation, frequency modulation etc. After this separation is performed, a digital synthesizer recomposes a new sound signal with the same string sound artifacts but carried on a different fundamental frequency.

As used herein, the term fundamental vibration frequency, or in brief fundamental frequency, is the lowest frequency of the vibration of a string.

This decomposition-recomposition arrangement opens the door for real time automatic digital tuning system. The string does not have to be tuned accurately to a specific fundamental frequency. The tuner system will measure the actual string fundamental frequency and based on that frequency decompose and recomposes the same string signal but with different fundamental frequency.

The element that decomposes the string signal to its components and recomposes the signal with different new fundamental frequency is referred hereinafter as synthesized tuner. The output of the synthesized tuner is referred hereinafter as the synthesized tuned signal.

The freedom created by ripping the link between the string frequency and the output signal frequency opens the door for a new range of features and new musical instruments.

Using synthesized tuner one can change the instrument tuning (the tuning ladder of multi string musical instruments) instantaneously. For example, in guitars the guitar tuning may be changed by a press of a button, from standard tuning (E-A-D-G-B-E) to open C tuning (C-G-C-G-C-E) without tuning the strings at all i.e., without changing the tension on the strings.

Synthesized tuner can be used as a virtual capo. If, for example, one put a capo on the fifth fret it change the open string guitar tuning from standard tuning (E-A-D-G-B-E) to (A-D-G-C-E-A). With synthesized tuner, this can be done by pressing a button without putting a capo on the guitar neck. The playable neck area in this case is not reduced as it is in a real capo usage and the full fret board area is usable for playing.

One well known problem in string instruments is the need to use different types (materials) and different size (diameter) of strings. Usually the thinnest string is both less comfortable to play and tends to snap. Using the invention, all string can be made from the same material and with the same diameter. String can be selected for most comfortable, most reliable and for giving the best sound performance without taking in consideration the actual open string fundamental frequency. Furthermore, the player can set the tension of the string to be the one that give him the best feeling or best sound and this tension do not relate to the actual fundamental frequency output sound of the string.

As used herein, the term open string refers to the state where the string length is maximal. The term open string fundamental frequency refers to the fundamental frequency of the string when the string is open, i.e., in maximal length. Unless otherwise stated or can be implicitly understood from text, the term fundamental frequency will be associated with the open string fundamental frequency. The term "played fundamental frequency" is the fundamental vibration frequency of a string in specific, usually not open, playing condition. This term refers to instrument that during play the player shortens the string length and therefore causes a change in the fundamental frequency of the string. Note that played fundamental frequency may be equal to open string fundamental frequency in the case where the player plucks on open string.

The string lengths dictated by fret board, i.e., the fret board spacing is related to the physical formula that connect between the string length and the fundamental frequency. To adjust the tone of a string a full octave the fret board need to have length of at least half the open string length. Furthermore, to play notes according to western tonal system the fret spacing is getting smaller as the frequency is getting higher so fret spacing is usually to wide near the guitar head and too small near the guitar body. The invention synthesized tuner provides the ability to build fret boards in any length and any spacing, including linear spacing. The played fundamental frequency deviations from the required musical notes (generated by the arbitrary fret spacing) corrected in this case in real time by the synthesized tuner. The out of tune of the string vibrations, caused by the actual fret spacing, is compensated as long as the actual activated fret is known. The activated fret can be detected either directly by locating the fingers on the fret board, e.g., using touch surface, or indirectly by measuring the played vibration frequency of the string.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways.

Synthesized Tuner Implementation Examples

Referring now to the drawings, FIG. 1 illustrates the construction and operation of a conceptual single string synthesized string tuner. String 100 is the musical instrument string. String 100 vibrations are digitized by digitizer 120. The output of digitizer 120 is a digital string signal denoted by s(t). The string signal s(t) is an input to fundamental string vibration frequency estimator 140. Fundamental string vibration frequency estimator 140, for abbreviation refer hereafter as frequency estimator, perform the estimation under the control of synthesized string tuner controller 160 which is a part of the musical instrument controller and optionally receive information regarding the instrument setup and status. For example, synthesized string tuner controller 160, for abbreviation refers hereafter as tuner controller, receives a command from the musician to perform tuning of the instrument. During tuning, tuner controller 160 instructs frequency estimator 140 to measure the string fundamental frequency while the musician plucks the open strings. Alternatively, frequency estimator 140 measures continuously the played fundamental frequency of the string. Using the current fingers positions over the fret board and/or the fret board geometry of the instrument and by analyzing the intervals that the string signal is stable, i.e., not in initial pluck transient (attack) and not in vibration finale transient (decay), frequency estimator 140 determine first the played fundamental vibration frequency of the string. By matching the allowable ratio between the played fundamental frequency and the open string fundamental frequency, frequency estimator 140 calculates the open string fundamental frequency. The open string fundamental frequency is denoted by $f_s$. Based on the instrument setup, tuner controller 160 sets the desired open string fundamental frequency for the string, denoted by $f_d$. For example, if the string is the highest string of a guitar with standard guitar tuning, the string fundamental frequency should be E4, i.e. 329.63 Hz. Tuner controller 160 in this case will set the desired open string fundamental frequency of the string to 329.63 Hz. Synthesized Tuner 180 gets the digitized string signal s(t) and transform it to the desired sound signal d(t). This digital transformation is based on the measured string fundamental frequency $f_s$ provided by frequency estimator 140 as well as the desired fundamental frequency $f_d$ provided by tuner controller 160. The digitizer sampling rate is based on accurate time base such as crystal oscillator hence it is known and accurate. The string fundamental frequency can be estimated with relative high accuracy. The desired fundamental frequency is known exactly and hence the desired signal tune accuracy is similar to tone accuracy achieved by known in the art music synthesizers. Even if the string is not tuned for the desired output sound, tune is not required for the string and the desired tone will be played in all finger position over the fret board.

The term digitizer refers to means that capture the vibrations and convert them to signal in digital form. Digitizer 120 are well known in the art and comprises string vibration pickup that convert the vibrations to eclectic signals and a sampler, i.e. Analog to digital converter that convert the analog signal to a stream of digital bits that can be manipulated by digital signal processing. Any type of pickup technology can be used. In particular, magnetic pickups that are popular in electric guitars can be used. Other pickups such as piezoelectric, optic and acoustic, i.e. microphones, may be used as well. Any kind of ADC can be used in digitizer 120. Flash, successive approximation and sigma-delta ADC technology can be used. The sampler accuracy, the number of bit as well as the sampling rate, is set to meet the accuracy and number of harmonics that are desired to be processed by the instrument and may change from instrument to instrument. In general, Nyquist criteria for the sampling rate versus the maximum signal frequency should be met. Frequency estimators are well known in the art in many fields and many algorithms are available. Tuner controller 160 is a general type controller and is well known in the art. Any microprocessor, micro controller or discrete digital logic can implement tune controller 160.

The implementation details of synthesized tuner 180 will be provided next. It is to be understood that the invention is not necessarily limited in its application to the details of construction of synthesized tuner 180 as well as the arrangement of the components 140 160 and 180 and the partition between them and/or methods set forth in FIG. 1. The invention is capable of other embodiments or of being practiced or carried out in various ways. For example, synthesized tuner 180 may get only the difference between $f_s$ and $f_d$. The string estimator can be implemented as part of the synthesized tuner, etc.

Figure 2:
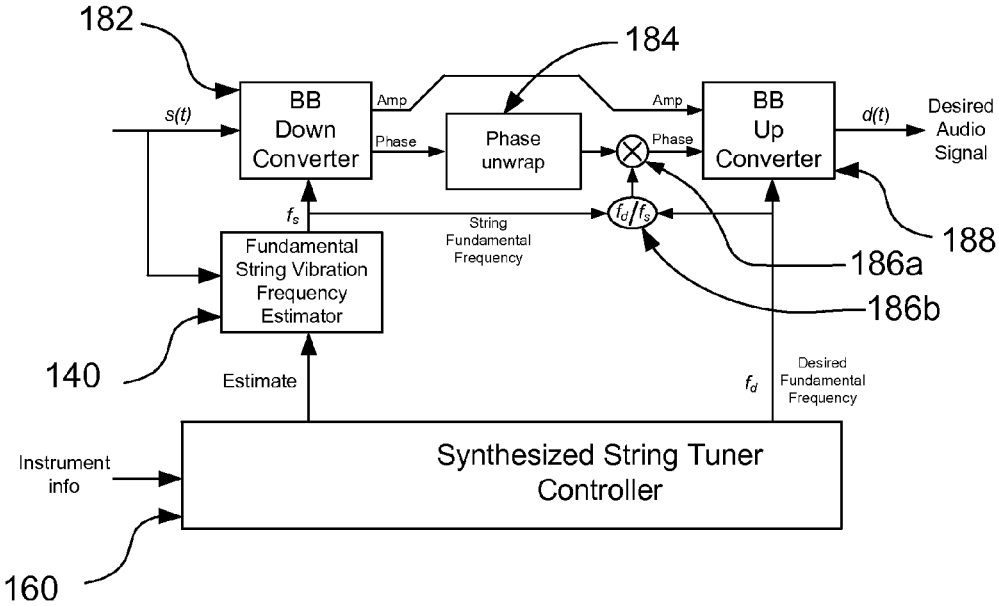
FIG. 2 is a block diagram of simple synthesized tuner in accordance with an exemplary embodiment of the invention.

Reference is made now to FIG. 2. FIG. 2 illustrates a simple embodiment of synthesized tuner 180 of FIG. 1. Frequency estimator 140 and tuner controller 160 were described in FIG. 1. Synthesized tuner 180 is comprised from elements 182 to 188. Baseband down converter 182 gets the string signal s(t) and down convert it to complex envelope baseband signal. The down conversion is done using the estimated fundamental string vibration frequency $f_s$. Formally the complex envelop baseband signal, $S_{BB}$ is given by $$S_{BB} = \frac{1}{\sqrt{2}}[s(t) + j\hat{s}(t)] \cdot \exp(-j2\pi f_0 t)$$

Where $\hat{s}(t)$ is the Hilbert transform of s(t). The complex baseband signal amplitude is transferred directly to the baseband up converter 188. This complex envelop signal retain all information of the string vibration amplitude including the initiation phase after plucking. The complex envelop signal does not contain the information of the original fundamental frequency.

The complex baseband signal phase is manipulated by elements 184, 186*a* and 186*b* before transferred to baseband up converter 188. While a simple down and up conversion, or equivalently performing a single frequency shift is optionally possible in some scenarios and may be used as well, the reason for the additional phase processing will be presented next. The baseband signal phase is transferred to phase unwrap 184. Phase unwrap elements are well known in the art and they regenerate a continuous phase signal that illuminates the $2\pi$ jumps occurring in complex BB representation. For example, for a pure sine wave signal, the phase unwrap output is a straight line with a slope proportional to the sine wave frequency. The phase unwrap signal is multiplied by multiplier 186*a* with a coefficient calculated by divider 186*b*. The coefficient is calculated by dividing the desired frequency $f_d$ with the string fundamental frequency $f_s$. The multiplied phase signal is transferred to the baseband up converter 188 and using the desired fundamental frequency the up converter 188 creates the synthesized tuned output signal. Formally the output signal is given by $$d(t) = \mathrm{Real}\{S'_{BB} \cdot \exp(j2\pi f_d t)\}$$

Where $S'_{BB}$ is the modified complex envelop and d(t) is the desired output signal.

To better understand how this embodiment achieves its goal lets take for example the highest string of standard guitar. In standard guitar the higher string should be tuned to 329.63 Hz. Lets assume in our case that the string is not tuned and its open string fundamental frequency is 310 Hz. Frequency estimator 140 will measure the string fundamental frequency to be 310 Hz. When we pluck the open string, digitizer capture the string signal and down converter 182 down convert the signal using the estimated fundamental frequency of 310 Hz. After converting to BB when the string signal is stabilize to its fundamental frequency the baseband signal frequency will be zero. Tuner controller 160 set the desired frequency to 329.63 Hz and since the phase of the baseband signal is constant (baseband frequency is zero), the output signal for this string (in open state) will be 329.63 Hz as required, i.e. the output signal is tuned.

Consider now the case the musician plunked on the string with a finger set on the 12th fret. In this case, the string will vibrate exactly on twice the frequency, i.e., the played fundamental frequency is 620 Hz (In 12th fret the string length is half). The frequency of the BB signal will be 620−310=310 Hz. Without the phase processing the output frequency will be the base band frequency plus the desired fundamental frequency, 310+329.63=639.63 Hz. However for tuned string the frequency, in this case, should be 2×329.63=659.26 Hz. With the phase processing, divider 186*b* is set the phase multiplier coefficient to 329.63/310=1.0633. The phase multiplier 186*a* adjusts the base band frequency to 310*1.0633=329.63 Hz and the output signal frequency will be 329.63×329.63=659.26 Hz as desired.

In similar fashion, any position on the fret board that the musician presses its finger on, the 310 Hz un-tuned string frequency will be converted by the synthesized tuner to an output signal with frequency that is identical to the frequency that was produced by the string if it was tuned to 329.63 Hz.

If the string fundamental frequency is higher then the desired fundamental frequency, for example the string frequency is 360 Hz, the multiplier coefficient will be less then one and the frequencies after the multiplier will be scaled down respectively.

The synthesized tuned output signal contains all the characteristics of the original signal including its amplitude, time profile, initial and fading characteristics as well as the frequency modulations and harmonics. However, phase multiplication is not linear and might distort the output signal. As rule of thumb the bigger the multiplication coefficient the bigger the distortion. Furthermore, the phase multiplication has capture effect which means the frequency shift is based on the fundamental frequency and the string signal harmonics will shift based on the fundamental frequency.

There are many ways to reduce some of the distortions created by this simple embodiment. One way is to down convert the signal to frequency close to zero. In this case, the frequency estimator, based on its own measurements or based on a side information of the finger position on the fret board, transfer to the down converter not the open string fundamental frequency but the played fundamental frequency $f_s(n) = f_s * 2^{(n/12)}$ and the up converter gets instead of $f_s$ the up conversion frequency of $f_d(n) = f_d * 2^{(n/12)}$ where n is the current fret position or the note index. The phase multiplier coefficient still set to be $f_s/f_d$.

As used herein, the term note index refers to an integer number have injective function to the ratio between the open string fundamental frequency and the played string fundamental frequency. While the mapping can take any values, in western music tonal system and most of the musical instrument the mapping between the note index n and the frequencies ratio is $2^{(n/12)}$ and each increment in the index represent half tone increment.

Figure 3:
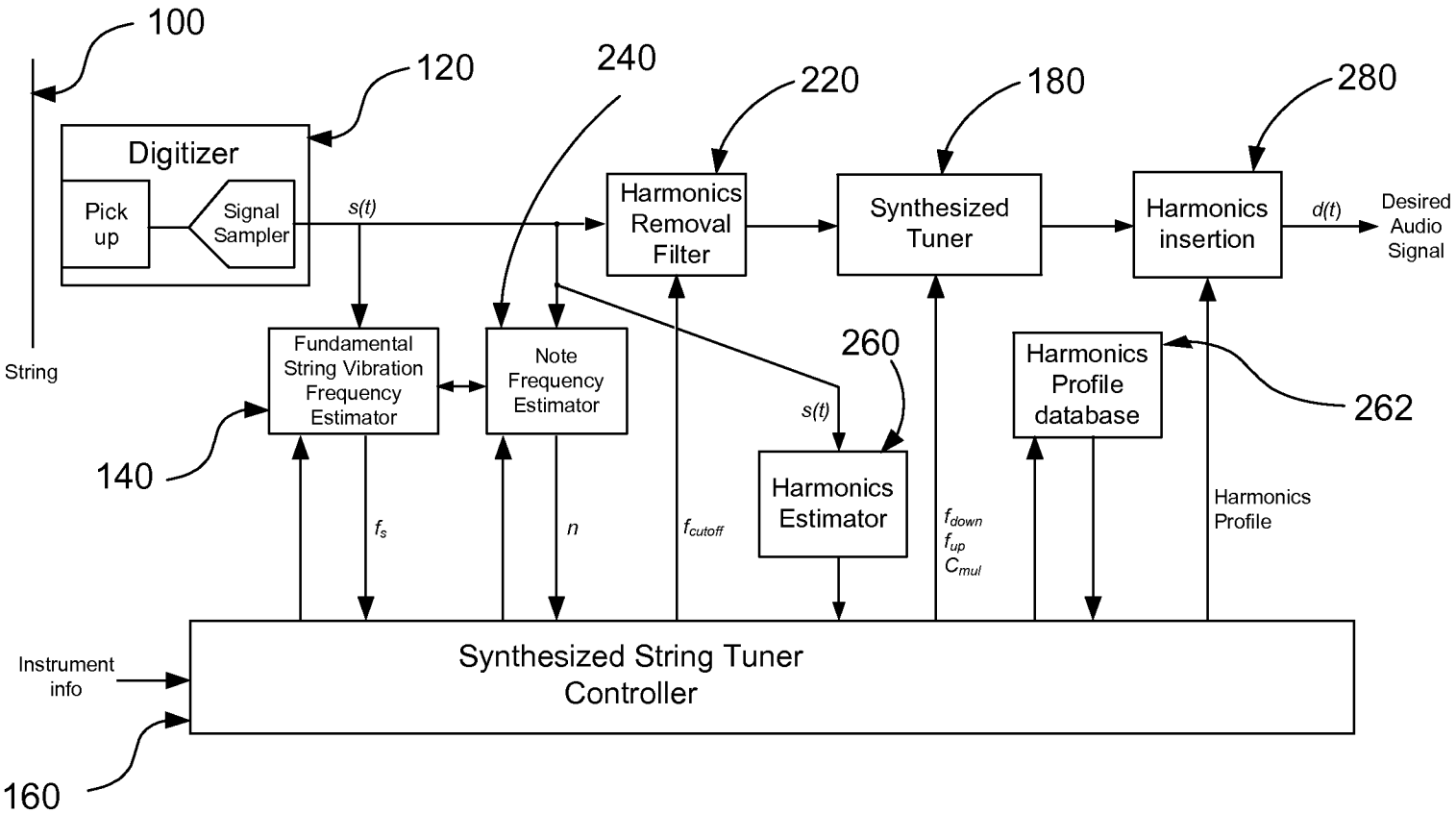
FIG. 3 is a block diagram of single string more advanced system.

Another approach to reduce the distortions is to decompose the string signal from its harmonics. Since the harmonics frequencies are at least twice the fundamental frequency it is quit simple to filter out the harmonics whenever the fundamental frequency is known. FIG. 3 illustrates another block diagram of string synthesizer tuner that combines both note index estimator and harmonics removal (filtration) before performing the synthesized tuning and harmonic re-insertion after performing the synthesized tuning. In the figure, String 100, Digitizer 120, Frequency estimator 140 and Tuner controller 160 are functioning in similar manner as in previous embodiments. Note frequency estimator 240 estimates the note index of that currently playing tone. Note index is estimated based on the fundamental frequency estimator and prior knowledge of the frets geometry. Tuner control 160 provides to note frequency estimator 240 the estimated open string fundamental frequency and note estimator 240 continuously and instantaneously estimate the played fundamental frequency and search for the closest possible frequency that meet the fret geometry. Note estimator 240 transfers the note index n to tuner control 160. In western instrument tonal system note index n is zero or positive integer (0, 1, 2, 3, . . . ) and the actual note frequency is $2^{(n/12)}$ multiplied by the desired fundamental string frequency. Optionally or alternatively, non western tonal system is used. Open string fundamental frequency estimator 140 and note frequency estimator 240 are closely related and they can share resources and exchange directly information as illustrated in the figure. Alternatively, a single estimator performing the function of both estimator is implemented.

To reduce synthesized tuner 180 distortions the current embodiment remove the harmonics from the string signal. The string signal, s(t), is transferred to harmonics removal filter 220. The cut-off frequency of the harmonics removal filter 220 is set by tuner controller 160 based on the fundamental frequency estimator 140 measurements and optionally based on the note frequency estimator 240 measurements as well. The "striped" string signal (without the harmonics) is transferred to synthesised tuner 180. Synthesized tuner 180 is similar to the synthesized tuners discussed above and the down conversion frequency, up conversion frequency and the phase multiplication coefficient is provided by tuner controller 160. The string signal, s(t), is optionally transferred to harmonics estimator 260. Harmonic estimator estimates the actual harmonics produced by string 100. Estimate of harmonics is well known in the art and can be done by measuring the actual harmonic amplitude and phase coefficients of the signal in the frequency domain or by averaging several cycles of the signal in the time domain. Several other techniques can be used as well. The harmonic data, referred hereinafter as harmonic profile, is stored and used to insert the harmonics back to the signal by harmonics insertion unit 280. The insertion can be done by applying non linear function that regenerate the desired harmonics to the signal or by directly replace each sine wave between two successive zero crossing with the desired time domain pattern. Tuner controller 160 instructs harmonic insertion unit 280 to generate harmonics that are similar to the harmonics that was removed from the original signal or alternatively, instruct harmonic insertion unit 280 to generate harmonics taken from harmonic profile database 262. Harmonic profile database 262 stores sampled signals taken from different "golden model" of musical instruments. Additionally or optionally, harmonic profile database 262 stores standard MIDI sound waveforms.

Figure 4:
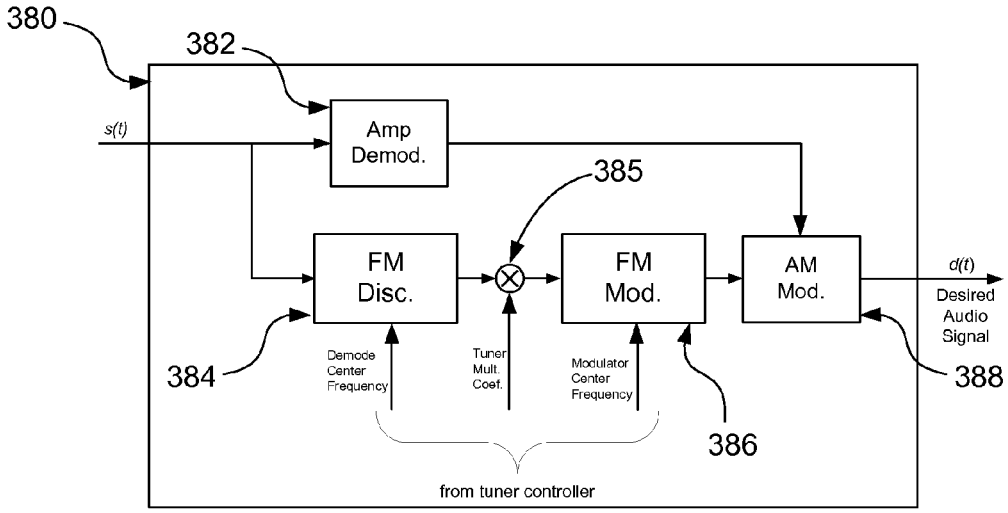
FIG. 4 is a block diagram of modulator demodulator based synthesized tuner in accordance with an exemplary embodiment of the invention.

According to another embodiment of the invention, the synthesized tuner decompose the signal to FM and AM components, adjust the FM signal and re-modulate the signal back with a different FM center frequency. FIG. 4 illustrates synthesized tuner using this alternative embodiment. Synthesized tuner 380 transfer the input signal to amplitude demodulator 382 and FM discriminator, i.e. FM demodulator, 384. The FM discriminator 384 center frequency is set by the tuner controller in accordance to the string estimated frequencies. This can be either the open string fundamental frequency or played string fundamental frequency. The FM demodulated signal is transferred to multiplier 385. The multiply coefficient is set by the tuner controller. The coefficient is set to the quotient between the desired string fundamental frequency and the actual measured sting fundamental frequency. Multiplier 385 output is transferred to FM modulator 386 as the modulating signal. The center frequency of FM modulator 386 is set according to the desired output fundamental frequency of the string. The output of FM modulator 386 is transferred to AM modulator 388. AM modulator 388 gets its modulating signal from amplitude demodulator 382. The output of AM modulator 388 is the desired output signal.

Figure 5:
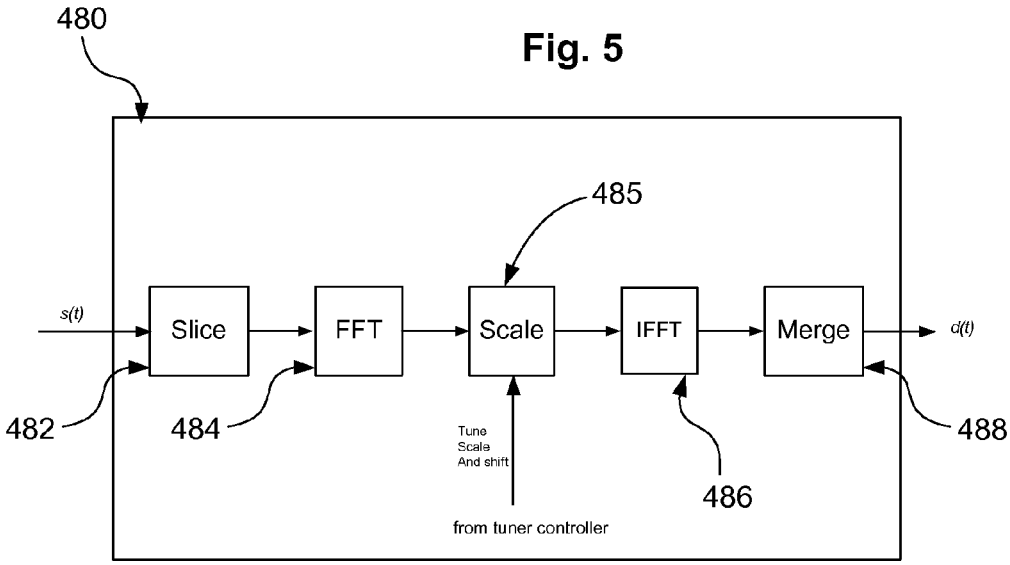
FIG. 5 is a block diagram of FFT based synthesized tuner in accordance with an exemplary embodiment of the invention.

According to yet another embodiment of the invention, the signal tuning is done in the frequency domain. The input signal is sliced and transferred to an FFT. The tuning is done in the frequency domain. Then the signal transformed back to time domain using IFFT. FIG. 5 illustrates synthesized tuner using this alternative embodiment. Synthesized tuner 480 transfer the input signal to slicer 482. Slicer 482 collects a block of samples, optionally preprocess the block, and transfer the block to the FFT 484. The FFT 484 results are transferred to Scaling block 485. Scaling block 485 shifts the frequency domain signals (analogous to frequency up or down convert) as well as scales the frequency domain signals, i.e. stretch or shrink the spectrum (analogous to phase multiply or time domain shrink or stretch respectively). Stretching the spectrum generates higher frequency string vibration effect and shrinking the spectrum generates lower frequency string vibration effect. The scaling is done using interpolation on the frequency FFT samples (bins). When scaling block 485 stretches the spectrum the higher frequencies that fall out of the frequency range are discarded. With proper frequency sample rate those frequencies are anyway greater then the hearing bandwidth. When scaling block 485 shrinks the spectrum the higher range is padded with zeros.

The scaling factor as well as the shift is set by the tuner controller in accordance to the string estimated and desired fundamental frequencies. In an exemplary embodiment of the invention, Scale unit 485 gets the scale and shift instructions from the tuner controller. Additionally or alternatively, the scale is set by tuner controller, and the shift is determined automatically in scaling block 485 by setting the shift to be the shift that provides an harmonic pattern. While the scale provide the correction that need to be done for the fundamental frequency, the shift provide the frequency offset that need to induced to the signal to generate an harmonic pattern that would mimic a similar harmonic pattern that would be generated if the string was tuned to the desired fundamental frequency. The scaled version of the spectrum is transferred to IFFT 486. The IFFF output is transferred to merging block 488. Merging block 488 takes care for creating smooth transition between the slices. This can be done by multiplying the slice with proper phase or other smoothing techniques.

Figure 6:
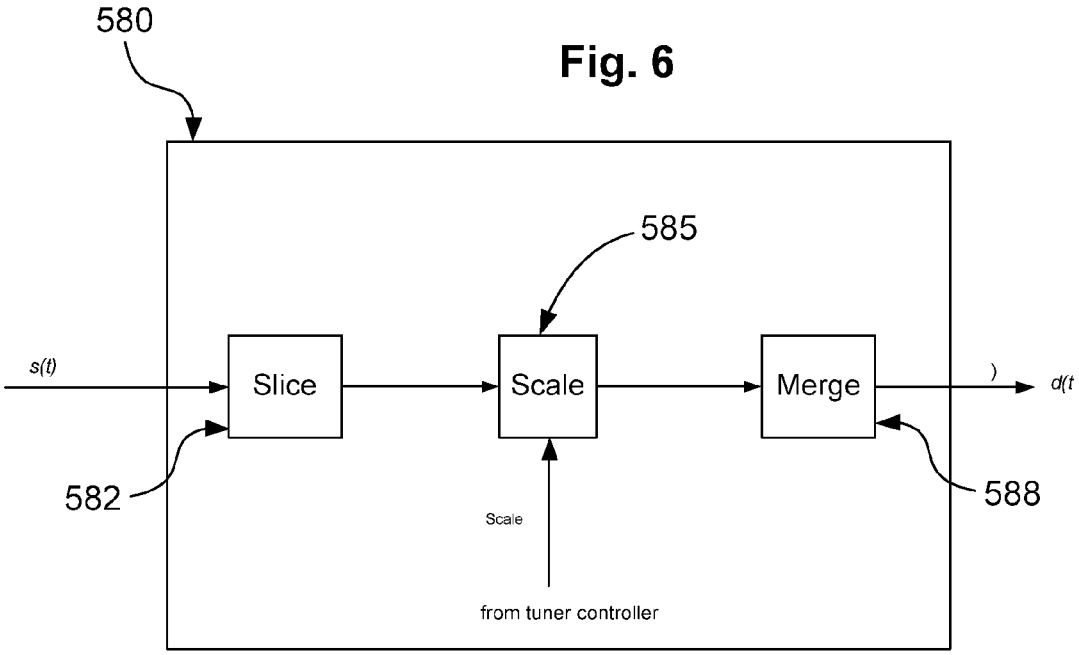
FIG. 6 is a block diagram of time based processing synthesized tuner in accordance with an exemplary embodiment of the invention.

According to yet another embodiment of the invention, the signal tuning is done directly on the time domain. The input signal is sliced and transferred to a time scale unit. The time scale unit stretch or shrink the signal in time. The scale unit transfers the signal to merge unit that connect the time slices smoothly. FIG. 6 illustrates synthesized tuner using this alternative embodiment. Synthesized tuner 580 transfer the input signal to slicer 582. Slicer 582 transfers the slice to scale unit 585. The scale unit stretch or shrink the signal in time. Stretching the signal in time lowers the string vibration frequency. Shrinking the signal in time makes string vibration frequency higher. Scaling is done using interpolation or extrapolation of the samples and is well known in the art. Two effects should be take care during this process, first the slice time duration in the slice unit output should be the same as the slice duration in the slice unit input. Second, low frequency characteristics of the signal created by the player finger, like the pluck rate, should not be scaled. To overcome those problems the slice is first filtered with very low frequency filter (few Hertz) and a low frequency version of the amplitude is generated. Then the slice is sliced again to three parts: (1) beginning, (2) middle and (3) end of the slice. In case of shrinking, the sub-slices are shrunk and place in the beginning, middle and end of the output slice. Since the sub-slices were shrunk, there are two gaps in the output slice. The gaps are filled with cycles from both sides until the gap is closed. If there is discontinuity in the meeting points, the start slice and the end slice are moved outwards until phase continuity achieved. Then the outer edges are truncated. The last step is to correct, i.e. modulate, the amplitude of the created slice according to the signal envelop and the low frequency filtered signal.

When the slice is stretched, scale unit 585 is also slicing the slice to three sub-slices. Each slice is stretched and put in place in the output slice. Since the sub-slices were stretched, there are two overlap regions in the output slice. The overlaps are removed and the meeting points, like in the shrink case, are corrected. The outer sub-slices are moved to create phase continuity. Again, this step is followed by a step that correct the amplitude of the generated slice according to the envelop of the signal and the low frequency filtered signal.

The output slice of the scale unit 585 is transferred to merge unit 588 that takes care to smoothly connect the slices.

Time domain processing may be done in various ways and various slicing techniques. In an exemplary embodiment of the invention, time domain scaling is done on the fly without slicing. In an exemplary embodiment of the invention, slicing is done with variable slicing block size according to the signal characteristics.

While the application demonstrates varies ways to perform the synthesized tuning of the string vibration signal to the desired tuned frequency signal, it is apparent to those skilled in the art that there are many other combinations and architectures and algorithms that may be used to achieve the same goal.

For the sake of clarity and brevity timing consideration was not presented in the above exemplary embodiment, however one need to take care, in some of the embodiments, to the delay of processing in each path and to balance the delays. It is also important that the total delay of the synthesized tuner will be kept low, i.e., less then 20 milli-seconds, so the player will not notice the delay.

Since the string output sound is generated electronically and is played through speakers or headphone and since the string vibrations are creating its own sound it is important to design the instrument in such a way that the string self audio signal will be as weak as possible. Generally speaking, musical instruments with resonance box (sound box) should not be chosen.

Full Musical Instrument Examples

Reference is now made to the following examples, which together with the above descriptions illustrate some embodiments of full musical instruments in accordance with the invention in a non limiting fashion. In the examples it is assumed that there is a synthesized tuner for at least one string, and preferably for all the instrument strings. It is assumed that the synthesized tuners are providing the desired tone regardless of the specific way the synthesized tuner is implemented. The examples emphasize the overall system aspects and features of the instruments equipped with synthesized tuners in accordance with the current invention.

Figure 7:
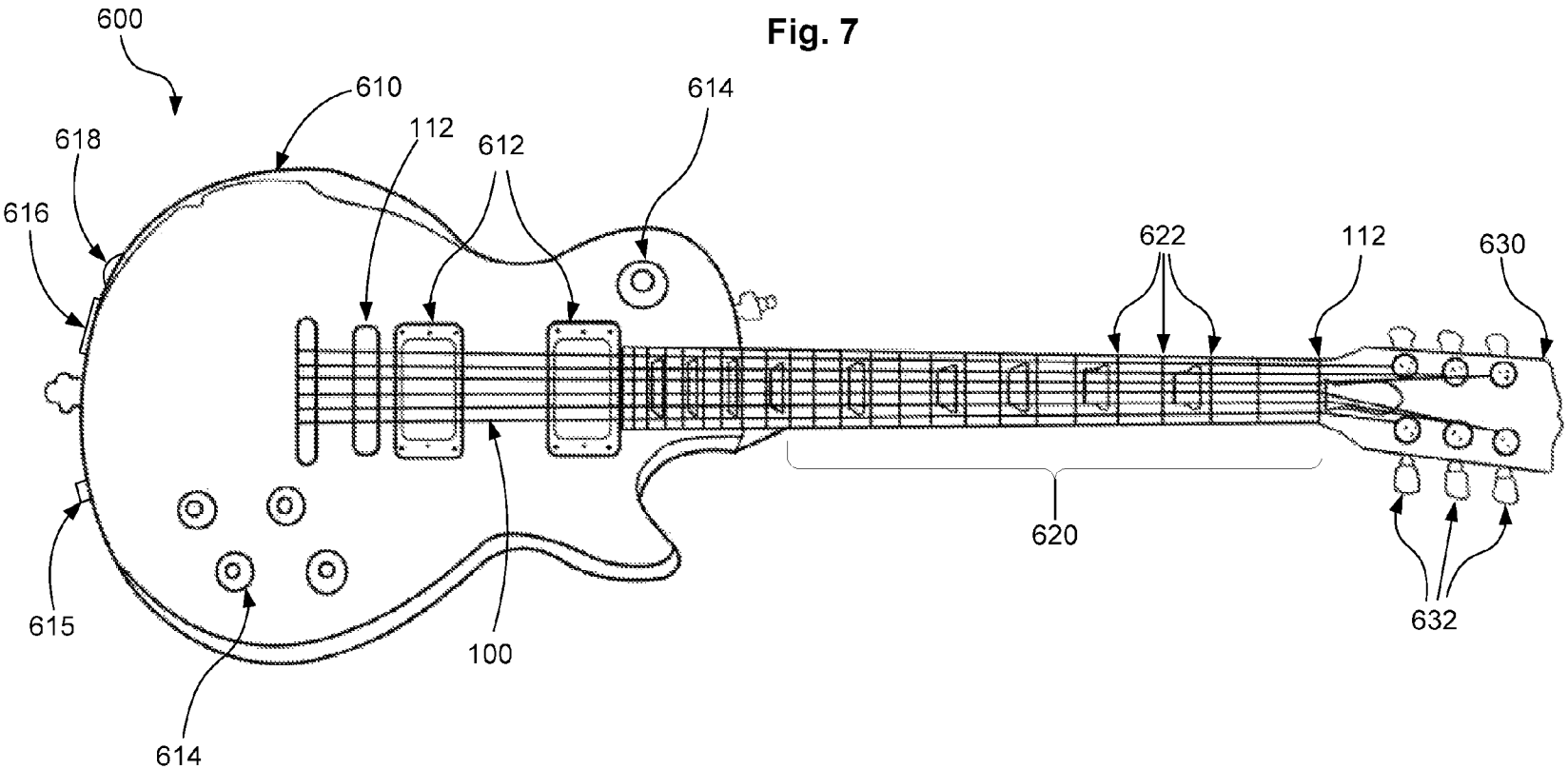
FIG. 7 is an electric guitar retrofit in accordance with an exemplary embodiment of the invention.
Figure 8:
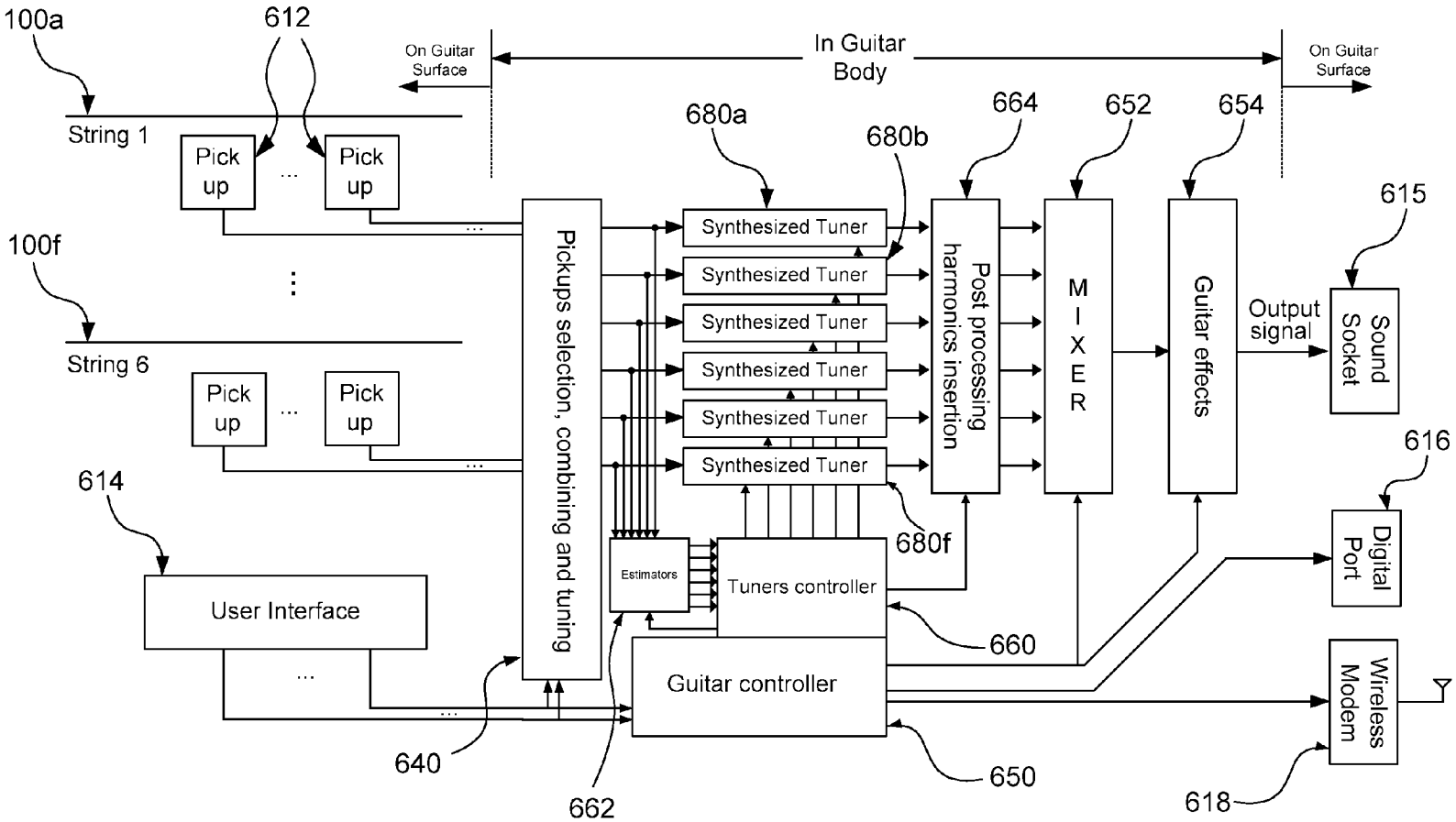
FIG. 8 is a block diagram of the electric guitar retrofit presented in FIG. 7 in accordance with an exemplary embodiment of the invention.

Reference is made now to FIGS. 7 and 8. The embodiment of FIGS. 7 and 8 illustrate a popular Gibson Les Paul electric guitar with retrofit or upgrade according to the current invention. Reference is made now to FIG. 7. As can be seen in the figure, guitar 600 is a standard electronic guitar comprises body 610, neck 620 and head 630. Guitar 600 has six strings 100 that are held between two string locks 112 one attached to body 610 and the second is between the neck 620 and the head 630. Strings 100 are stretched with tuning pegs 632. To produce the desired tone, the guitar player presses his fingers between frets 622 on the fret board located on the neck 620. String 100 vibrations are picked by pickups 612. Unlike standard Les Paul guitars, pickups 612 are hexaphonic pickup, i.e. each string vibration is picked separately. Typically pickups 612 will be magnetic pickups but the invention is not limited to magnetic pickups and different hexaphonic pickup such as piezoelectric or optical pickup may implement the invention. User interface elements 614 are also available on the guitar surface. FIG. 7 illustrate five user interface elements as in the classic Les Paul guitar. In the original guitar the top switch is used to select: (1) the left pickup; (2) the right pickup or (3) combination of the two pickups. The four knobs on the bottom left are used to set the volume and tone of the two pickups. This exemplary invention keeps backwards compatibility with the original Les Paul guitar user interface so the user interface is kept as similar as possible to the original guitar. The guitar also have back compatible mode so guitar playing without using the invention is also possible according to this exemplary embodiment. The user interface and the operation of the guitar according to this exemplary embodiment will be detailed in a user interface section later. Many variant and different user interface element may be used and the provided one is just a simple exemplary version trying to be similar as possible to the popular Gibson Les Paul guitar.

Pickups 612 are connected to a synthesized string tuner unit as illustrated in FIG. 8. The guitar output sound signal is provided in sound socket 615. In addition, there are two optionally new ports: (1) digital wired port 616 and digital wireless port 618 for advanced features that will be presented later.

Reference is now made to FIG. 8. FIG. 8 illustrates the electronic block diagram of electric guitar 600 in accordance to this exemplary embodiment. The guitars strings 100*a* to 100*f* vibrations are picked by pickups 612. The pickups are hexaphonic so total 6×2=12 pickups are located in the guitar surface (only four are illustrated in FIG. 8, two for the first string, string 100*a*, and two for the sixth string, string 100*f*). Pickups 612 are connected to pickups selection, combining and toning unit 640. In the current example, unit 640 performs the same function as the original Gibson Les Paul guitar. Unit 640 selects or combines the left and right pickups based on the user interface switch and set the volume and tone of each pickup. While in the original Gibson Les Paul guitar this is done on the combined signal from all strings, in the current invention, unit 640 selects or combines the signals from each string pickup separately. Pickups selection, combining and toning unit 640 provides six separate output signals each corresponds to one string, corresponding to string 100*a* to string 100*f* respectively. The outputs of unit 640 are transferred to six synthesized tuners 680*a* to 680*f* respectively. Each unit 640 output is also transferred to estimators unit 662. Estimator unit may include fundamental frequency estimator, note estimator and harmonics estimator as describe in previous embodiments. Estimators unit 662 is controlled by tuners controller 660. Estimators 662 outputs are transferred to tuners controller 660. Tuner controller 660 is part of guitar controller 650. Guitar controller controls all guitar functions, read user interface 614 and control all processing performed by the guitar. Synthesized tuners 680*a* to 680*f* are controlled by tuners controller 660 to tune the strings signals to the required tones according to the user interface setting and the estimators 662 measurements. The outputs of synthesized tuners 680*a* to 680*f* are transferred to post processing unit 664. Post processing unit 664 optionally perform on each string signal harmonic insertion as taught by previous examples or perform other per string signal post processing signal processing as required. The outputs of processing unit 664 are transferred to mixer 652. Mixer 652 combines the six strings signals to one guitar signal. This signal is transferred to guitar effect unit 654. Guitar effect unit 654 adds, optionally, additional digital effects that are performed on the full guitar signals. Those effects can include distortion, filtering, "wha-wha", modulation, "Vibrato", echo, reverb, etc. Guitar effect unit 654 output signal is transferred to the sound socket 615. In an exemplary embodiment of the invention, a standard ¼ inch jack socket is used. Optionally, digital wired port 616 and digital wireless port 618 for advanced features are provided and connected to guitar controller 650. Digital wired port 616 can be USB port, FireWire port or Ethernet port or any other similar port the used to communicate digital information. Digital wireless port 618 can be Wi-Fi, Bluetooth or any other wireless communication protocol.

In an exemplary embodiment of the invention, a rechargeable battery power source is used. This battery can be recharged through digital wire port 616. Additionally or alternatively, power supply is delivered using the sound socket 615.

User Interface and Operation

The standard Les Paul user interface include 5 elements: (1) pickup switch; (2) left pickup volume; (3) left pickup tone; (4) right pickup volume; (5) right pickup tone. The pickup switch in the original guitar contains 3 positions: (1) left pickup used; (2) both pickups used; (3) right pickup used. In the current embodiment a 12 states rotary switch is used for all five elements. The top switch is the guitar mode switch. To provide backward compatibility the current embodiment contains position (2) to (4) in the mode switch as a backward compatibility mode. The full 12 modes are as follows:

(1) off
(2)-(4) backward compatibility mode
(5) remote control mode
(6) tune mode
(7) guitar setup 1
(8) guitar setup 2
(9-11) Pickup selection. Like 2-4 but in synthesized tuner mode
(12) Off Modes (2)-(4), (5) and modes (9)-(11) are the play modes. In play modes the other four UI elements control the pickups in similar fashion as the classic Les Paul guitar. The only change in the UI elements is that instead of continuous knob, twelve 12 state rotary switch are used.

Since, optionally the guitar is powered by rechargeable battery, states (1) and (12), the two edges of the mode selection rotary switch, are off modes that do not consume power. State (5) is remote mode. In remote mode the setup of the guitar is done using a remote host. The remote host can be hand held device or smart phone or a laptop or desktop computer connected via the wired or wireless ports. State (6) is tune mode. In tune mode the player pluck on the strings in open state so the fundamental frequencies of the strings as well as other features can be measured by Estimators 662. State (7) and (8) are (local) setup mode of the guitar. The setup is done using the four bottom left rotary switches. Fore example, one rotary switch can be used to set a capo position. Another can be used for guitar tuning, i.e. the ladder of the tunes of each string. Other switches can be used for setting the strings harmonics, reconfigure the guitar as a bass guitar, setting the post processing effects as well as other setting parameters. The parameters are sampled and stored by pressing on a button located on the top of the mode tottery switch. The user interface in accordance with the invention may be implemented with many various ways and variants.

In modes (9)-(11) the actual output tone of the strings are in accordance to the setup done in states (7) and (8) and in accordance to the tuning performed in state (6). The output sound of the string is determined by the setup and not the actual fundamental vibration frequency of the strings. Actual string fundamental frequency is irrelevant and the player may use standard strings that are not fully tuned. The player may use strings that are completely out of tune. For example, the player can install the same type of string in all six string position and in modes (9)-(11) the guitar will still sound as if a standard set of strings, exactly tuned of course, is used.

Figure 9:
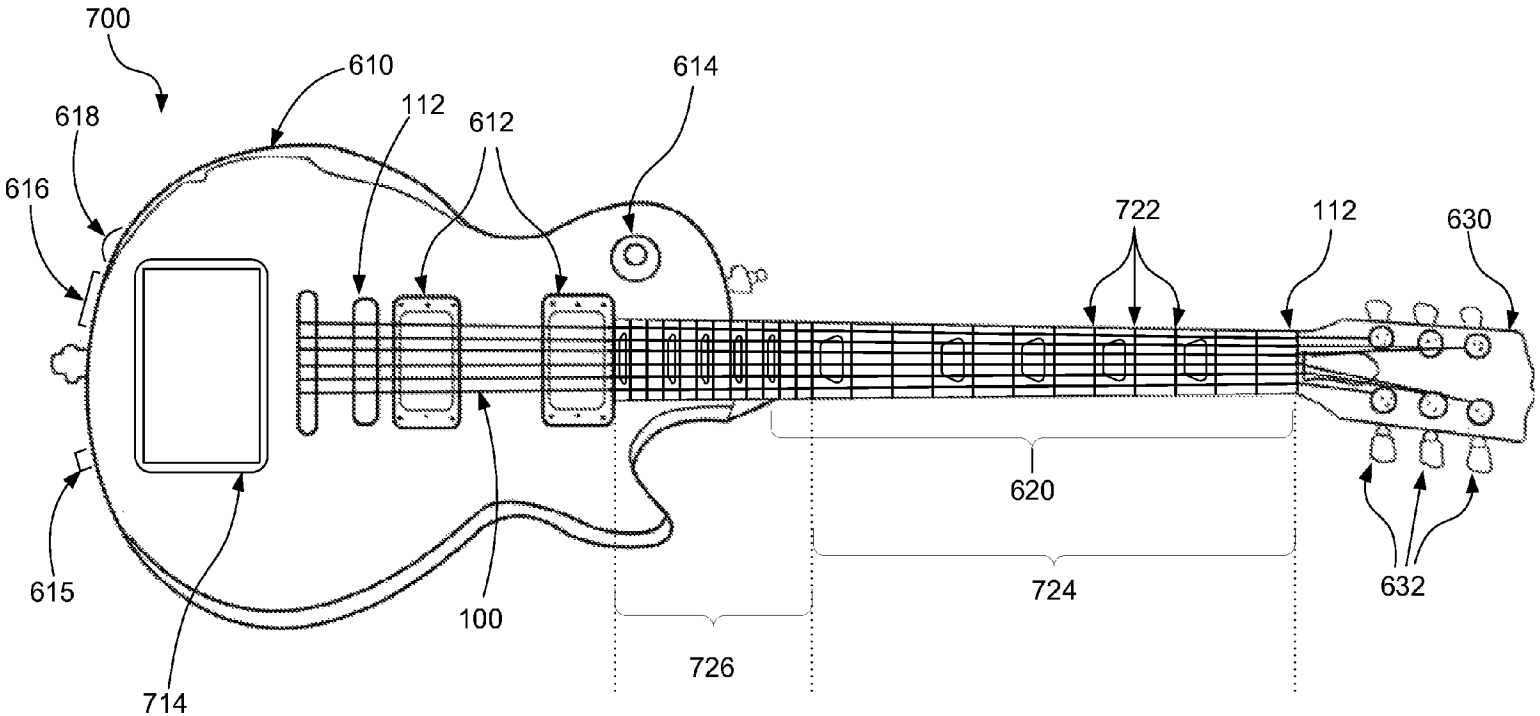
FIG. 9 is another electric guitar in accordance with an exemplary embodiment of the invention.

FIG. 9 illustrates yet another embodiment of electric guitar with more radical changes. Guitar 700 comprises from body 610, neck 620 and head 630 similar to the previous embodiment. Most guitar components are also similar to previous embodiment. Two major changes are provided. The first, frets 722 locations are different then standard guitar frets locations. Frets 722 spacing is different in two regions 724 and 726. In region 724 the frets are spaced equally with 2.5 cm apart from each other. In region 726 the frets are spaced also equally but with 1 cm apart from each other. Each region contains 12 gaps and provides a change in tone of one octave. Note that if such an arrangement is played on strings without the use of synthesized tuners the actual played frequencies will not by half tone apart. Using synthesized string tuners, a half note tune between adjacent fret boxes can be maintained. Furthermore, the range of notes that can be produced by each string in this case is two octaves, which is more then usually achieve in standard electronic guitar. In an exemplary embodiment of the invention, fret spacing is designed with 36 boxes to allow 3 octaves tuning per string. The fret spacing, the length of the neck and strings can be changed arbitrarily to achieve the goal of the guitar designer or player. In the case of this embodiment, region 724 is designed to be used for chord playing and the spacing is comfortable to create chords on the fret board. Region 726 is designed to be used for guitar solo playing and the spacing is comfortable for guitar solo playing. To allow the right compensation in the frequency, the fret spacing is known a priori to the tuner controller. Based on the knowledge of the fundamental frequency of the string and the fret spacing, the string frequency in each fret box is calculated. The desired frequency in each fret box is also known to the tuner controller. Usually it will be according to the western tonal music standard, i.e., the interval between two adjacent notes (or fret boxes) is half tone in a 12-tone scale. Other tonal systems including quarter tones, like in Arabic music and other non 12-tone scale like have been used in the far east can be easily set and played with synthesized tuner as well. For example, change of the fret tonal spacing from half tone to quarter of a tone is just a setup on the user interface, where in a standard guitar such a change is not possible and requires totally different string instrument. The actual finger location on the fret board can be estimated using the instantaneous string vibration frequency. However, knowing directly the fingers location is preferred. In an exemplary embodiment of the invention, Regions 724 and 726 comprise a touch surface that provides the locations of the fingers on the fret board to the tuner controller.

The second change between this embodiment and the previous embodiment is in the user interface. Guitar 700 comprises touch screen 714 located on body 610. Since the variety of setups that can be performed on the current embodiment, the player can set the guitar using touch screen 714. Many styles of user interface can be implemented using touch screen 714 and the variety of setup parameters can be easily set.

Other string instruments can implement according to the invention. In an exemplary embodiment of the invention, an electric violin with synthesized string tuner is implemented. Such an instrument with small form factor device can mimic all bowed string instrument such as viola, cello and contrabass in a single instrument. With just a press on a button a violin can play as a contrabass. Off course, synthesized tuner version of viola, cello or contrabass embodiment can be implemented as well and each embodiment can play the role of the other bowed string instrument as well.

Figure 10:
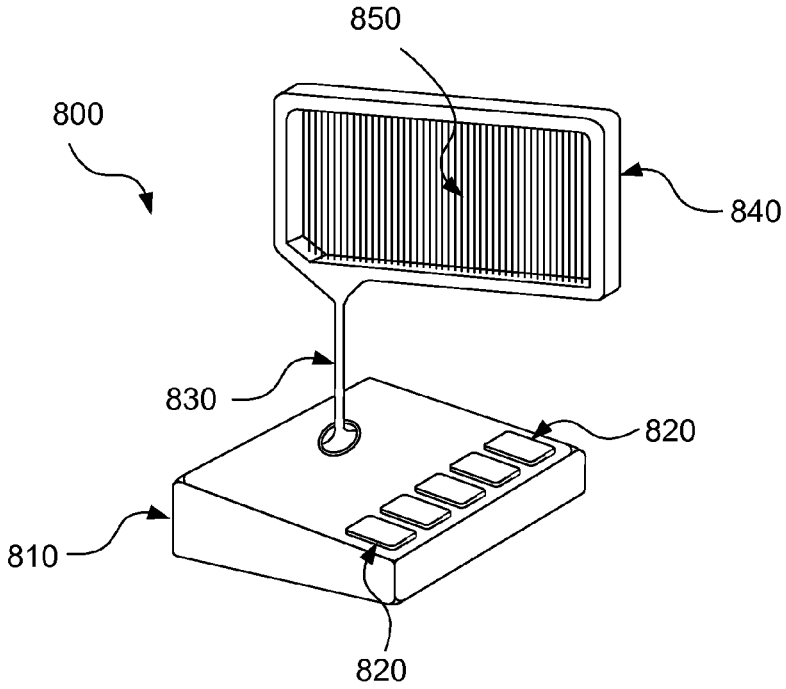
FIG. 10 is an electronic harp in accordance with an exemplary embodiment of the invention.

FIG. 10 illustrate a conceptual synthesized tuner electric harp. Base 810 is standing on the floor. The base comprises pedals 820. Leg 830 is connected to the base 810. Optionally, leg 830 is capable to rotate. Harp body 840 is a frame that comprises strings 850 inside the frame. Since the strings output frequency is determined by synthesized tuners the body shape is not restricted. In the figure rectangular shape is illustrated. Rectangular shape can be implemented since string length no longer plays an important role in the string final tone. Strings 850 are connected to piezoelectric pickups (not shown on the figure) in at least one end of the strings. The pickups are connected to the rest of the electronic system that comprises the synthesized tuners and the tuner controller, located preferably in base 810. Pedals 820 are used to change string tone, e.g. change the octave, or change the sound profile of the string.

There are more then hundred classic and traditional string instruments that have different type and shape many of them can be redesign and exploit synthesized string tuner invention which give a freedom to enhance the instrument and get rid of the limitations imposed by the fundamental connection between the string length, string width and string type and the actual tone of the string.

Figure 11:
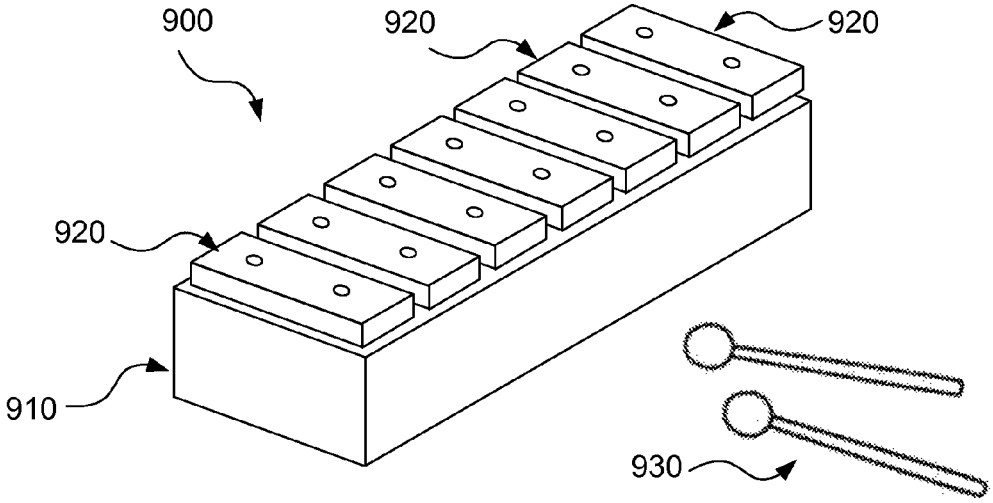
FIG. 11 is an electronic xylophone in accordance with an exemplary embodiment of the invention.

Although string vibration is the most popular way to create music sound, the invention is not limited to strings and other musical instruments such as percussion instruments and wind instrument can implemented using the invention, For example, FIG. 11 illustrate a synthesized tuner version of xylophone. Xylophone 900 comprises from base 910, row of vibrating bars 920 and sticks 930. Bars 920 are raised from the base and connected using two connection points to base 910. When struck using sticks 930, bars 920 vibrate and produce sound. In standard xylophone bars are in different size (length and/or width) so they will produce different vibration frequency. In this exemplary embodiment bars 930 are identical and vibrate in the same frequency. The connection points of the bar comprise piezoelectric pickups that receive bars 920 vibrations. Alternatively, laser based pickup that measure the distance of the bars from base in different locations of bars 930 is used as a pickup. Using synthesized tuner each bar is tuned to different frequency. The user interface for the xylophone setup is located in base 910 (for clarity not shown on the figure). The synthesized tuner, tuner controller and all other electronics, as well as optionally amplification unit and loudspeaker also located inside the base.

It is expected that during the life of a patent maturing from this application many relevant musical instrument will be developed and the scope of the term is intended to include all such new technologies a priori.

The terms "comprises", "comprising", "includes", "including", "having" and their conjugates mean "including but not limited to".

As used herein, the singular form "a", "an" and "the" include plural references unless the context clearly dictates otherwise. For example, the term "a string" or "at least one string" may include a plurality of strings.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A musical instrument comprising:

(a) one or more strings;

(b) string vibration digitizer for at least one string;

(c) an estimator that measures the fundamental vibration frequency of said string; and (d) a synthesized tuner, that conditioned upon at least said estimated frequency, generate an audio signal that comprises the characteristics of the original string vibration signal with a different fundamental frequency, wherein said synthesized tuner comprises frequency down conversion followed by phase multiplication processing, further followed by frequency up conversion.

2. The musical instrument of claim 1, wherein said musical instrument comprising identical strings and said synthesized tuner is used to tune each said string to different frequency.

3. The musical instrument of claim 1, wherein said synthesized tuner is used to make a significant change in the range of frequencies produced by said instrument.

4. The musical instrument of claim 1, wherein said synthesized tuner is used to alter the fundamental frequencies produces by said string in different fret board positions.

5. The musical instrument of claim 1, wherein said musical instrument is a guitar or a violin or a harp or a bowed string instrument or a plucked string instrument or a struck string instrument.

6. The musical instrument of claim 1, wherein said synthesized tuner comprises at least one of (a) frequency demodulation; (b) amplitude demodulation; (c) phase signal multiplication; (d) frequency modulation (e) amplitude modulation; (f) harmonics removal; (g) harmonics insertion; (h) frequency domain stretch, shrink and shift operations; and (i) time domain stretch, shrink and shift operations.

7. A musical instrument comprising:

(a) one or more strings;

(b) a string vibration digitizer for at least one string;

(c) an estimator that measures the fundamental vibration frequency of said string; and (d) a synthesized tuner, that conditioned upon at least said estimated frequency, generate an audio signal that comprises the characteristics of the original string vibration signal with a different fundamental frequency, wherein said synthesized tuner comprises harmonics removal before the signal tuning and harmonics insertion after the signal tuning.

8. The musical instrument of claim 7, wherein said synthesized tuner comprises at least one of (a) frequency demodulation; (b) amplitude demodulation; (c) phase signal multiplication; (d) frequency modulation (e) amplitude modulation; (f) frequency down conversion; (g) frequency up conversion; (h) frequency domain stretch, shrink and shift operations; and (i) time domain stretch, shrink and shift operations.

9. The musical instrument of claim 7, wherein said musical instrument comprising identical strings and said synthesized tuner is used to tune each said string to different frequency.

10. The musical instrument of claim 7, wherein said synthesized tuner is used to alter the fundamental frequencies produces by said string in different fret board positions.

11. A method to tune musical instrument comprising:

(a) digitizing the vibration of at least one vibrating element of said instrument;

(b) estimating the fundamental frequency of the vibration; and (c) conditioned upon at least said estimated frequency, generate an audio signal that comprises the characteristics of the original vibration signal with a different fundamental frequency, wherein the said audio signal generation comprises frequency down conversion followed by phase multiplication processing, further followed by frequency up conversion.

12. The method of claim 11, wherein said vibrating elements are identical and said different fundamental frequencies are different frequency for each said vibrating element.

13. The method of claim 11, wherein said different fundamental frequencies make a significant change in the range of frequencies produced by said instrument.

14. The method of claim 11, wherein said musical instrument is a guitar or a violin or a harp or a xylophone or a bowed string instrument or a plucked string instrument or a struck string instrument.

15. The method of claim 11, wherein said step of generating an audio signal comprises at least one of (a) frequency demodulation; (b) amplitude demodulation; (c) phase signal multiplication; (d) frequency modulation (e) amplitude modulation; (f) harmonics removal; (g) harmonics insertion; (h) frequency domain stretch, shrink and shift operations; and (i) time domain stretch, shrink and shift operations.

16. A method to tune musical instrument comprising:

(a) digitizing the vibration of at least one vibrating element of said instrument;

(b) estimating the fundamental frequency of the vibration; and (c) conditioned upon at least said estimated frequency, generate an audio signal that comprises the characteristics of the original vibration signal with a different fundamental frequency, wherein the said audio signal generation comprises harmonics removal before the signal tuning and harmonics insertion after the signal tuning.

17. The method of claim 16, wherein said step of generating an audio signal comprises at least one of (a) frequency demodulation; (b) amplitude demodulation; (c) phase signal multiplication; (d) frequency modulation (e) amplitude modulation; (f) frequency down conversion; (g) frequency up conversion; (h) frequency domain stretch, shrink and shift operations; and (i) time domain stretch, shrink and shift operations.

18. The method of claim 16, wherein said vibrating elements are identical and said different fundamental frequencies are different frequency for each said vibrating element.

19. The method of claim 16, wherein said different fundamental frequencies make a significant change in the range of frequencies produced by said instrument.

20. The method of claim 16, wherein said musical instrument is a guitar or a violin or a harp or a xylophone or a bowed string instrument or a plucked string instrument or a struck string instrument.

* * * * *